US005691699A

United States Patent [19]

Vane et al.

[11] Patent Number: 5,691,699

[45] Date of Patent: Nov. 25, 1997

[54] SECURITY DETECTOR WITH OPTICAL DATA TRANSMITTER

[75] Inventors: Burton Warner Vane; Leigh Austin Laughlin, both of Fairport, N.Y.

[73] Assignee: Detection Systems, Inc., Fairport, N.Y.

[21] Appl. No.: 598,300

[22] Filed: Feb. 8, 1996

[51] Int. Cl.[6] ..... G08B 17/12

[52] U.S. Cl. ..... 340/578; 340/578; 340/628; 340/691

[58] Field of Search ..... 340/577, 578, 340/584, 628, 630, 332, 511, 525, 589, 588, 632, 691, 693; 250/573, 574; 356/437, 438

[56] References Cited

U.S. PATENT DOCUMENTS

| | | | |
|---|---|---|---|
| 4,688,021 | 8/1987 | Buck et al. | 340/522 |
| 4,827,244 | 5/1989 | Bellavia et al. | 340/514 |
| 5,471,194 | 11/1995 | Guscott | 340/518 |
| 5,475,364 | 12/1995 | Kenet | 340/525 |
| 5,566,022 | 10/1996 | Segev | 359/172 |

*Primary Examiner*—Jeffery Hofsass
*Assistant Examiner*—Daniel J. Wu
*Attorney, Agent, or Firm*—J. Addison Mathews

[57] ABSTRACT

A security detector including an optical emitter and a controller for determining detector specific values of predetermined parameters and operating the emitter to transmit a code representing the values. The controller periodically initiates test cycles of the detector, determines the detector specific values, and operates the emitter to transmit a bit stream including an alpha-numeric code representing the values. For a smoke detector, the parameters include atmospheric density, information for determining detector sensitivity and alarm threshold. The emitted radiation is in the visible spectrum and the controller operates the emitter to transmit one code at rates perceptible to humans and another code imperceptible to humans. The imperceptible code provides machine readable information as bytes of alphanumeric characters. Other features include a method and an optical reader for decoding and displaying the transmitted data.

19 Claims, 7 Drawing Sheets

SECURITY DETECTOR WITH OPTICAL DATA TRANSMITTER

DESCRIPTION

1. Field of Invention

The invention relates to security systems including detectors of security related events and more specifically to such detectors having optical emitters for presenting information and transmitting data pertaining to the detectors. According to one feature of the invention, such a security system further includes an optical reader for decoding and displaying the transmitted data.

2. Background of the Invention

Many security systems include fire and intrusion detectors that operate relatively independently of central control. They may receive power from a central panel, and report detected events there, but other important operations are completed independently of the control panel, within each individual detector, and stored or reported locally. Using a two wire smoke detector as an example, detector specific information often is retrieved by initiating a test sequence with a magnetic wand. The wand is long enough to reach a ceiling mounted detector, and closes a reed switch to run the test cycle and retrieve the desired information. The results of the test are then reported by sounding a local alarm or turning on a light emitting diode (LED) representing the alarm condition. At the end of the test, power to the detector is momentarily interrupted, releasing the reed switch and returning the alarm to its normal operating state.

In addition to magnetic wands, electromagnetic signals have been proposed for initiating test and other alternative cycles in smoke detectors. Bellavia et al. U.S. Pat. No. 4,827,244 mentions radiant energy from a flashlight, either continuous above a predetermined energy level or pulsed at a predetermined frequency. Bellavia also mentions sonic and radio frequency energy beamed toward the detector, and the use of a coded signal where one code initiates a test and another code silences an alarm from cooking smoke.

Although existing devices have numerous advantages, many still require a conscious effort, such as positioning a wand or operating a flash light, to initiate test functions. Even more troublesome, after the test is completed, existing detectors suffer from inadequate mechanisms for retrieving the test information. Electrical instruments can be coupled to the detector, but this is hardly satisfactory in large installations having ceiling mounted detectors that are difficult to reach.

SUMMARY OF THE INVENTION

The present invention is directed to overcoming one or more of the problems set forth above, and to improvements in detectors for initiating alternative detector functions and retrieving detector specific information. Briefly summarized, according to one aspect of the invention, a security detector is provided with an optical emitter and a controller for determining detector specific values of predetermined parameters and operating the emitter to transmit a code representing the values. The controller periodically initiates test cycles of the detector, determines the detector specific values, and operates the emitter to transmit a serial bit stream including a code representing the values. More specific features retrieve and transmit values for atmospheric density, alarm threshold and information from which the sensitivity of the detector can be determined.

According to one feature, the emitter transmits radiation in the visible spectrum and the controller operates the emitter to blink at first rates perceived by humans and to transmit at second rates not perceived by humans. The perceptible blink is relatively slow. The rate of the imperceptible transmission is much faster, and is machine readable with an optical detector and decoder. The first and second rates may be displaced in time, or the faster rates may be imbedded in the slower rates.

The invention includes a method of operating a detector including the steps of monitoring, testing and emitting, where the emitting step optically transmits detector specific information as a bit stream or in a first perceptible code and a second imperceptible code.

Another feature of the invention includes an optical reader. The reader decodes the transmitted data and displays the data as human readable alpha-numeric characters.

The invention provides an improved security detector that initiates testing and other alternative functions automatically, not requiring a conscious effort or exterior implement. Detector specific information, determined during the alternative function, is transmitted for remote reception, not requiring access to the detector, and in greater detail than previously available. A non-contacting reader aimed at a selected detector can retrieve and decode the information for recording, presentation on a suitable display or retransmission to a central location.

These and other features and advantages of the invention will be more clearly understood and appreciated from a review of the following detailed description of the preferred embodiments and appended claims, and by reference to the accompanying drawings.

DETAILED DESCRIPTION OF THE INVENTION

Figure 1:
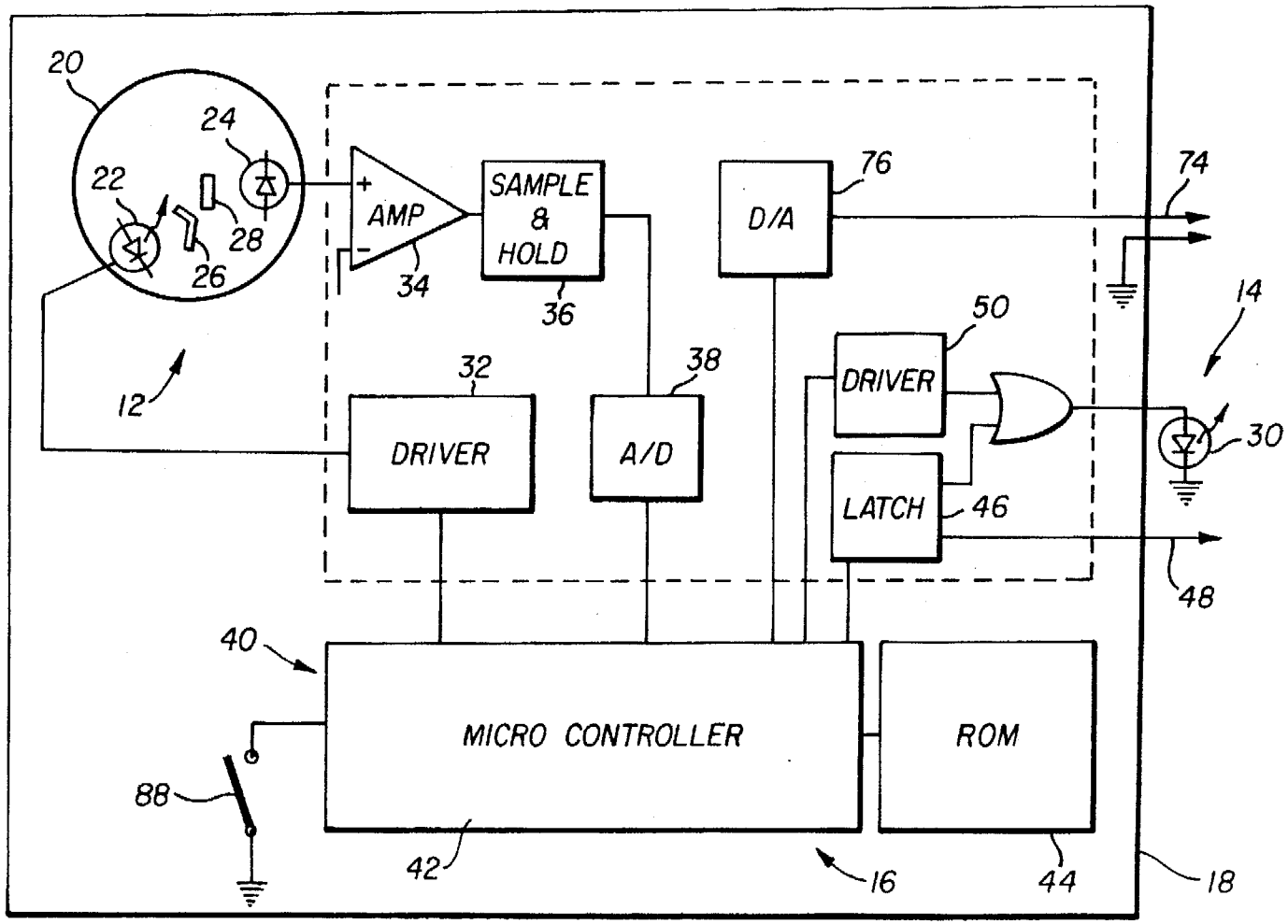
FIG. 1 is a block diagram representing a security detector in accordance with a preferred embodiment of the invention.

Referring now to FIG. 1, a preferred embodiment of the invention is depicted in a security detector 10. The detector 10 has a sensor 12 for detecting security related events, an emitter 14 of visible radiation for providing output signals and transmitting data, and a controller 16 for operating the detector in various modes including monitoring, testing and data transmission. Examples of security detectors are fire detectors, such as smoke and rate-of-rise heat detectors, intrusion detectors, such as microwave and infrared detectors, glass break detectors, and the like.

In this preferred embodiment, the detector 10 is a smoke detector defined by an individual housing 18. The housing 18 contains or supports the respective components of the detector and is adapted to be secured to a wall or ceiling with a corresponding mounting ring. The ring, in turn, electrically couples the detector to a central panel with one or more loops of other smoke detectors and detectors of other types, including those mentioned above. The central panel provides power to the detectors and receives alarm signals from the detectors. In most other respects, however, each respective detector has its own signal processing and operates independently of the central panel and the other detectors. Such systems often are referred to as two or four wire security systems, and are in contrast to more comprehensive systems, often called analog or multiplexed systems, where the central panel provides more signal processing and control and communicates more comprehensively with each detector.

The sensor 12 includes a dark chamber 20 containing an infrared light emitting diode (IRLED) 22 and a photodetector 24 sensitive to the infrared wavelengths of the IRLED 22.

The chamber 20 is described more completely in commonly assigned copending patent application Ser. No. 08/089,539, filed Jul. 12, 1993, hereby incorporated by reference into the present specification. Briefly, however, the chamber includes a hollow base and cap separated by a peripheral wall that blocks external light from the chamber without significantly restricting air circulation through the chamber. The peripheral wall has properties chosen to provide minimal resistance to the passage of products of combustion, usually called smoke, and particularly smoke particles of a size and type generated by a fire during its early stages of development. The interior surfaces of the chamber are black and shaped to reflect any incident light away from the optical sensor 22. The floor and cover include reticulated surfaces and septums, 26 and 28, for example, that reduce internal reflections within the chamber.

The IRLED 22 is mounted behind an aperture for directing infrared radiation in a relatively narrow beam across the otherwise dark chamber 20. The photodetector 24 is a photo diode on the opposite side of the chamber 20, at an angle of approximately 140 degrees, outside the IRLED beam. The photodetector 24 also is behind the septums 26 and 28, which block photodetector 24 from directly viewing the IRLED 22. Under clean-ambient conditions, background scatter is low and little radiation is reflected from the beam toward the photodetector 24. Its electrical output is low. When airborne products of combustion enter the chamber, however, the particles scatter radiation from the beam and reflect infrared energy toward the photodetector, increasing its electrical output. An alarm is activated when the resulting signal, after amplification, exceeds a predetermined threshold.

The alarm may include visual or audible warnings issued from the detector itself or from external generators connected through the control panel. One such visual device is a visible light emitting diode (VLED) 30, mounted on the detector housing where it is viewable from the vicinity of the detector. When the VLED 30 is energized to indicate an alarm, it identifies the detector that is in the alarm condition. This same VLED also is the emitter 14, referred to above, and serves a number of other functions. It blinks at relatively low human perceivable rates to signal when the sensitivity of the detector is outside an acceptable range, and it cycles at much higher rates not perceived by humans to transmit detector specific data from tests and other alternative functions. These other functions are described more fully hereinafter.

The IRLED 22, in dark chamber 20, is pulsed on for one hundred and fifty microseconds (150 μsec.) every seven seconds (7 sec.) by a temperature compensated current driver 32. The output of the photodetector 24 is amplified by a pulse amplifier 34, configured as a DC coupled current amplifier. After amplification, the signal is converted from an analog to a digital representation of the sensor output by a sample and hold circuit 36 and analog-to-digital (A/D) converter 38. Of course other digital and analog approaches can be employed.

Operation of the smoke detector is controlled by a micro controller 40 including processor 42 and memory (ROM) 44. It is the micro controller that times and initiates the energy pulses from IRLED 22. The micro controller also coordinates the photodetector 24 to take samples when the IRLED 22 is on, and performs other detector cycles such as the testing and data transmission. Again, other devices might be employed for controlling the operation of the detector, including discrete components and electrical circuits.

Prior to installation of the detector 10, preferably during its manufacture, each detector is calibrated on an individual basis and values for the resulting calibration parameters are stored by the micro controller 40 in ROM 44.

A first parameter represents an alarm condition, and is determined by circulating a standard calibration medium through chamber 20. The circulated medium represents the lowest percent obscuration per foot that should cause the detector to alarm, based on the sensitivity of the detector when it is first manufactured. The output signal that results from the test is measured and stored, preferably in digital form, for use by the detector during its monitoring operations.

A second parameter represents a corresponding output signal under clean-ambient conditions. This signal is measured without obscuration and is stored by the micro controller 40 in ROM 44 for later use in testing the sensitivity of the detector throughout its useful life. In the preferred embodiment, it is not actually the clean-ambient signal that is stored, but rather a digital representation of the difference between the alarm and clean-ambient signals. In accordance with other embodiments, both the alarm and clean-ambient output signals might be stored, or either one of the output signals and the difference between them. Still other embodiments might employ look-up tables, or the like, that would assign coordinate values representing the desired calibration factor.

After installation of the detector, and during its operation, the detector repeatedly samples the output from photodetector 24 and compares the output to the stored value representing an alarm condition. If the sampled value exceeds the alarm threshold, the micro controller sends an alarm signal to the control panel through latch 46 and conductor 48. It also energizes VLED 30 through an appropriate driver 50 to identify the detector that is in the alarm condition. In the preferred embodiment, the alarm is activated only after the threshold is exceeded by three successive samples. This reduces the possibility of an alarm caused by transient conditions such as cigarette smoke or airborne dust.

Figure 3:
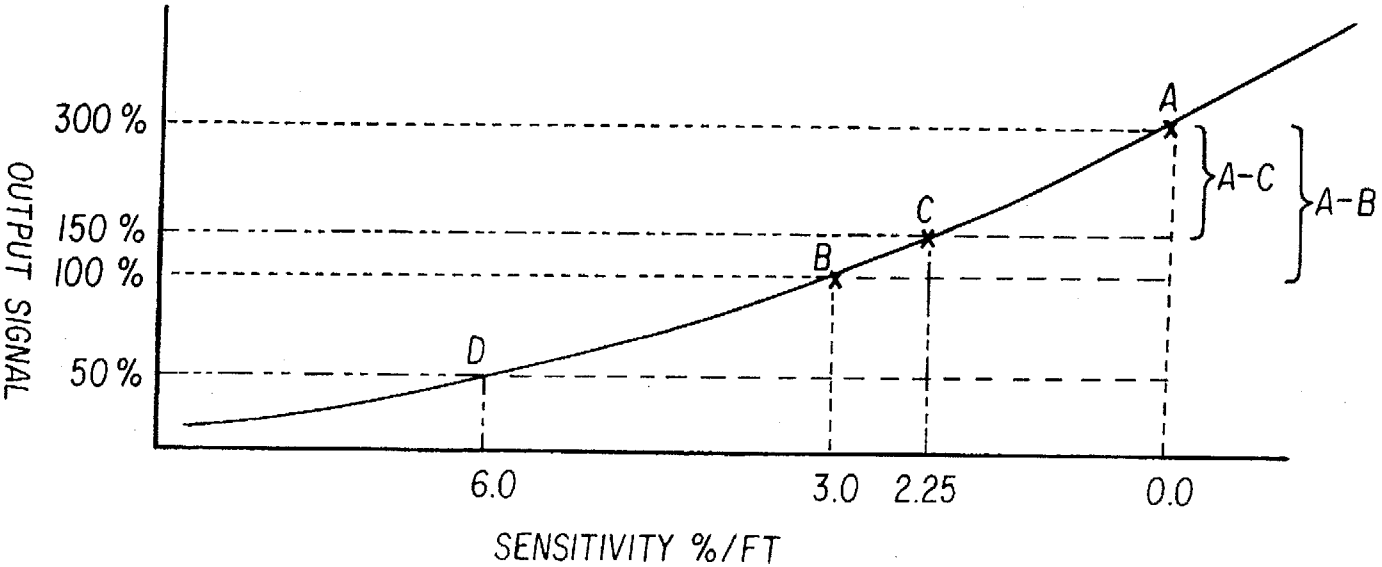
FIG. 3 is a chart representing information collected during manufacture, monitoring and testing of the preferred detector of FIG. 1.

Referring now to FIG. 3, Point A represents the alarm condition and Point B represents the clean-ambient condition. Immediately following calibration of the smoke detector, its sensitivity, measured as visible obscuration in percent per foot, is represented by the difference between points A and B, and is equal to the amount of obscuration in the gaseous medium used to calibrate the alarm threshold.

The difference between Points A and B is three percent per foot obscuration along the X axis, and is represented, for example, by an output signal along the Y axis of 200 millivolts, shown as a percent.

After installation, dust and other reflective material may settle in the chamber, accumulating over time. This increases the background scatter and reduces the amount of smoke required to reach the alarm threshold, thereby increasing the sensitivity of the detector and its propensity to false alarm. The detector also may become less sensitive than the calibrated sensitivity due to blockage of the emitter or other malfunction. In this case, more than the calibrated amount of smoke is required to reach the alarm threshold. Point C represents changes in the detector that increase its sensitivity. Two and a quarter percent per foot (2.25%/Ft.) obscuration will cause the detector to alarm from Point C. Point D, on the other hand, represents changes that decrease the detector's sensitivity. Six percent per foot (6%/Ft.) obscuration is required to reach the alarm condition from Point D.

Figure 4:
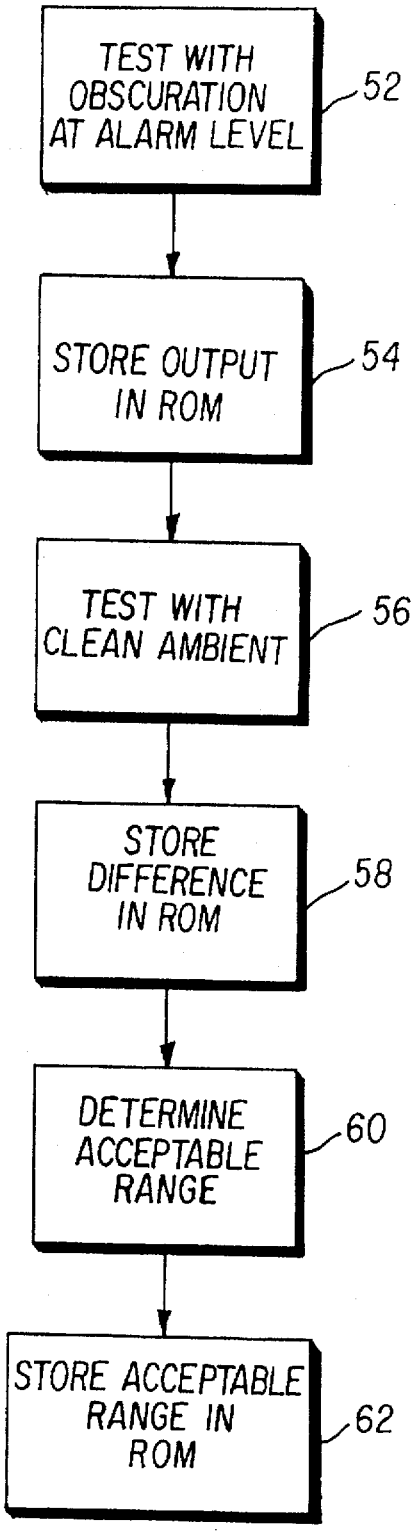
FIGS. 4–5 are flow diagrams representing the operation of the preferred detector of FIG. 1.

The values for the calibration parameters obtained during the initial calibration of each detector are used to determine and store a range of acceptable sensitivities for subsequent testing of the detector after its installation. Referring to FIG. 4, each detector is tested prior to installation, box 52, with a calibration sample representing an alarm condition, and the resulting output signal is stored in ROM, box 54, for later use. The detector is tested under clean-ambient conditions at approximately the same time, box 56, and the resulting output again is stored in ROM for later use, box 58. An acceptable range of sensitivities is determined, box 60, and the range, or its limits, are stored in ROM, box 62, for testing of the detector after its installation. Continuing with the example started above, Point C on FIG. 3 might represent the upper end of the acceptable range at 2.25%/ft. sensitivity and 150 millivolts (illustrated as one hundred and fifty percent on FIG. 3), while Point D might represent the lower limit at 6%/ft. sensitivity and 50 millivolts (illustrated as fifty percent in FIG. 3). Point C was selected based on one quarter of the Y axis distance between Points A and B, and Point D was selected based on one half of the Y axis distance between Point B and the x axis. Although other points might be selected, the selection is based on the parameters of each individual detector prior to its installation, preferably during its manufacture, and is stored to remain with the detector throughout its useful life.

Other sensitivity targets and ranges are preferred in some instances for compliance with requirements of the National Fire Protection Association (NFPA). The approach is substantially the same, but the values preferred would be an initial sensitivity of three and a half percent per foot (3.5%/ft.) sensitivity and a range of plus or minus point nine five percent per foot (0.95%/ft.). The acceptable range, then, would be from two and one quarter percent per foot (2.25%/ft) at one end to four point one five percent per foot at the other end (4.15%/ft.).

Figure 5:
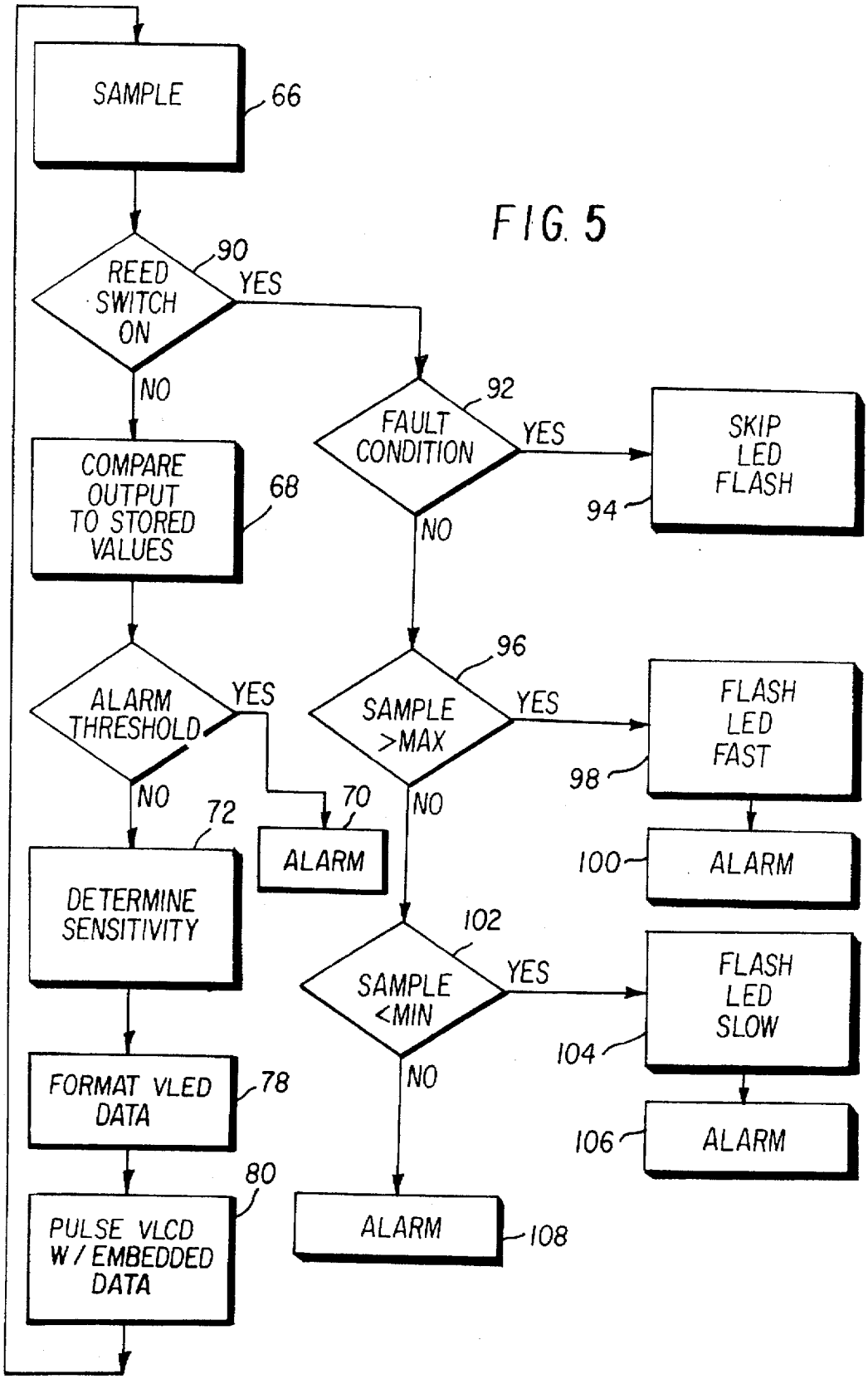
Figure 6:
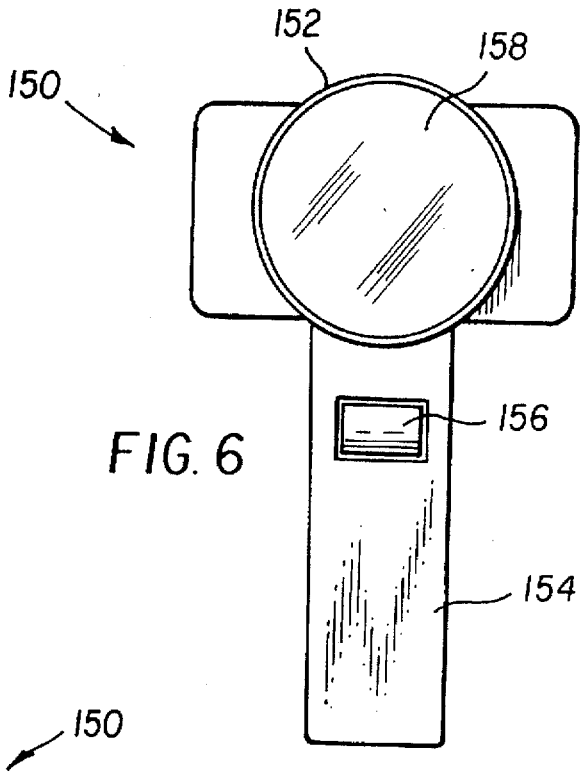
FIGS. 6 and 7 are schematic views representing a reader for use with the preferred detector of FIG. 1 for decoding and displaying the bit stream of FIG. 2.
Figure 7:
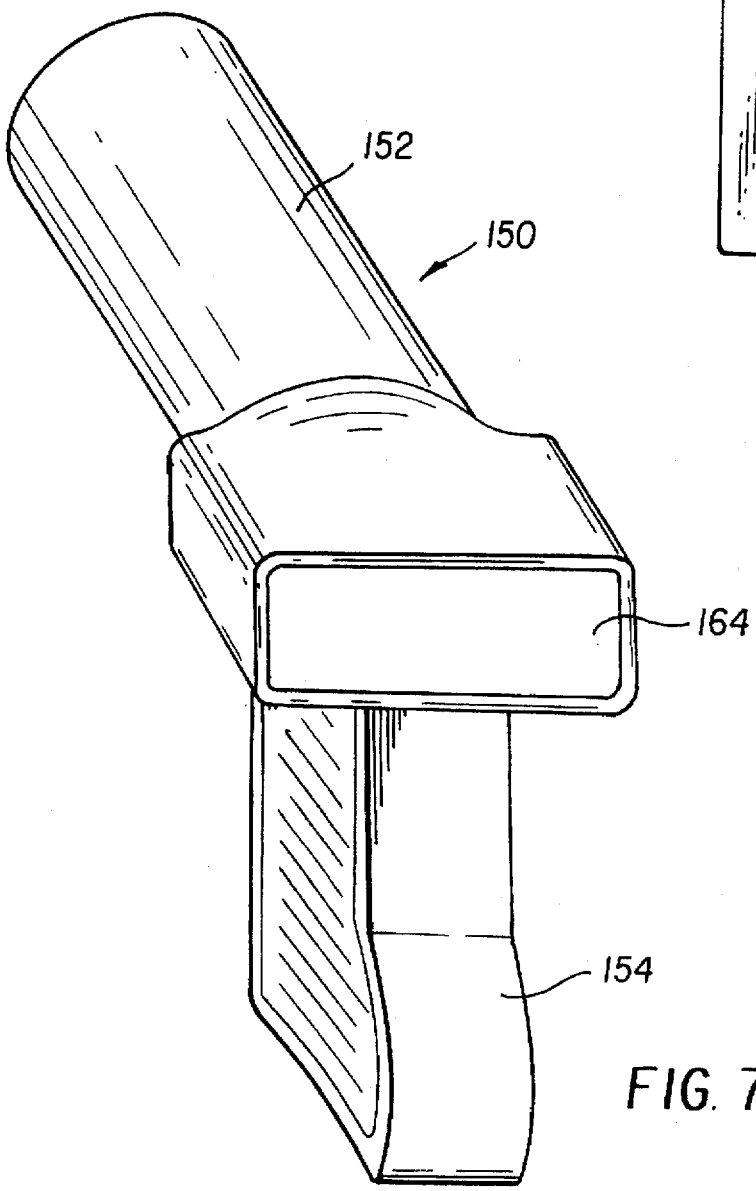
Figure 8:
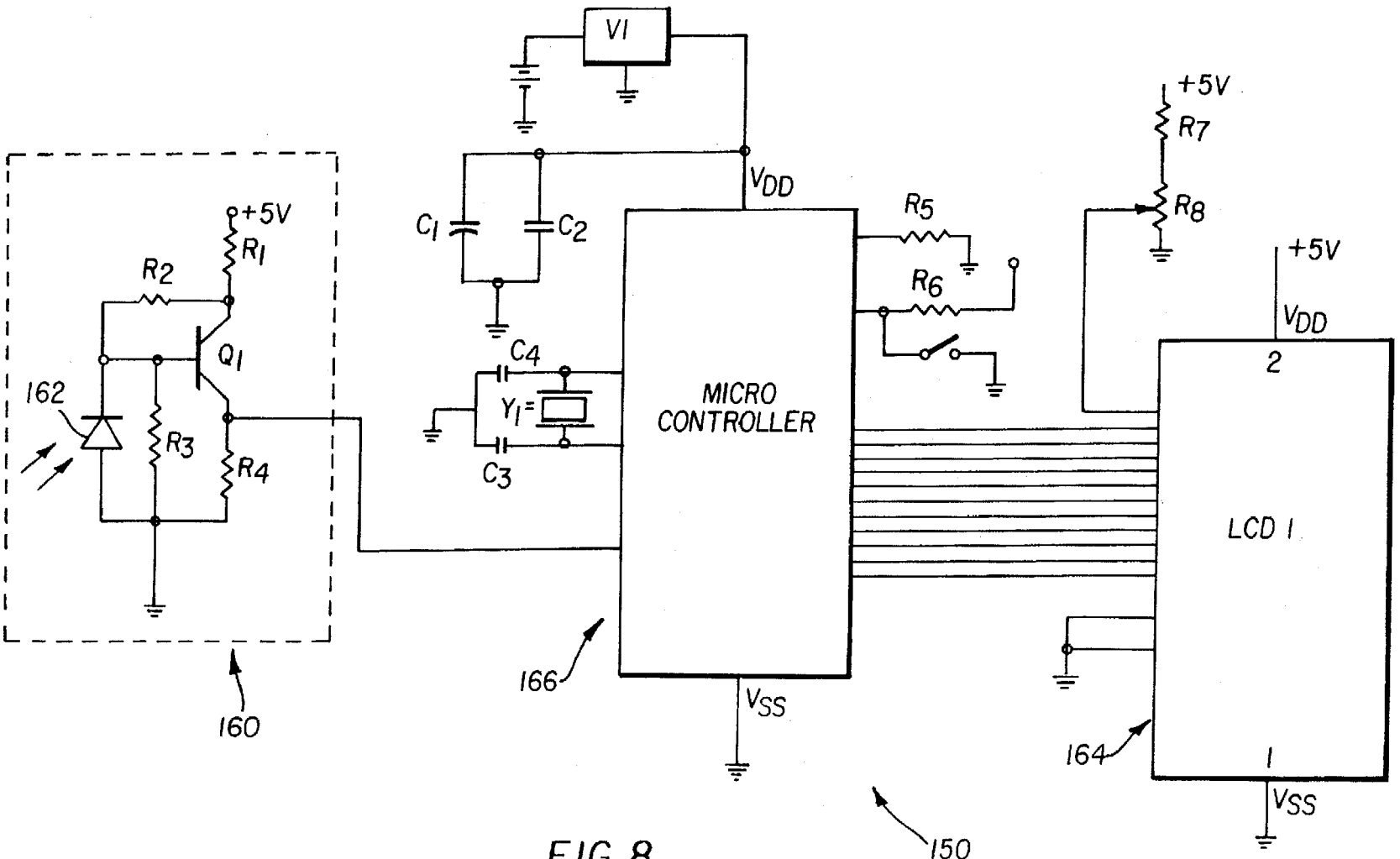
FIG. 8 is a schematic diagram of the electrical components of the reader of FIGS. 6 and 7.

FIG. 5 represents steps for testing the detector during use after installation. In its normal mode of operation, the detector samples ambient conditions, box 66, and compares the sample to the alarm threshold determined during calibration, box 68. If the monitored value exceeds the alarm threshold, the alarm is activated, box 70, as described above. If below the alarm threshold, the remaining sensitivity is determined, box 72, and made available as an analog signal at contacts 74 (FIG. 1). A digital-to-analog converter 76 is coupled between the micro controller 16 and the analog output 74.

The sensitivity determination is based on the relationships depicted in FIG. 3. Thus the sensitivity represented by point C can be approximated from the ratio of the difference A–C over the difference A–B. An output signal based on this ratio is made available by micro controller 40 at contacts 74.

In addition to providing a sensitivity signal, detector specific values of predetermined parameters are transmitted optically as a serial bit stream through VLED 30 and driver 50 (FIG. 1). The parameters in this preferred embodiment include the sample value, the alarm threshold, the clean ambient value when manufactured and notification of certain error conditions. Micro controller 42 formats the data for transmission, box 78 (FIG. 5), and transmits the data as a serial bit stream by pulsing VLED 30 at a relatively high rate, box 80.

Although test parameters are determined and transmitted automatically, a magnetic reed switch 88 (FIG. 1) also is provided for initiating a manual test sequence, box 90. In this case the micro controller first tests for fault conditions, box 92. A fault condition has no visible output, box 94, which indicates a bad detector that must be replaced. If there is no fault condition, the test output is compared to the acceptable range. In the preferred embodiment the test output is compared first to a maximum at one end of the range, decision box 96. If the output exceeds the maximum, the LED 30 (FIG. 1) is flashed at one visibly discernible rate, such as twice a second, box 98, and the alarm is activated, box 100. If the output does not exceed the maximum, it is compared to the minimum at the other end of the range, decision box 102. If below the minimum, the LED 30 is flashed at another discernible rate, such as once every two seconds, box 104, and the alarm is activated, box 106. If the output is within the acceptable range, the LED does not flash, but the alarm is activated to indicate a successful test, box 108.

Figure 2:
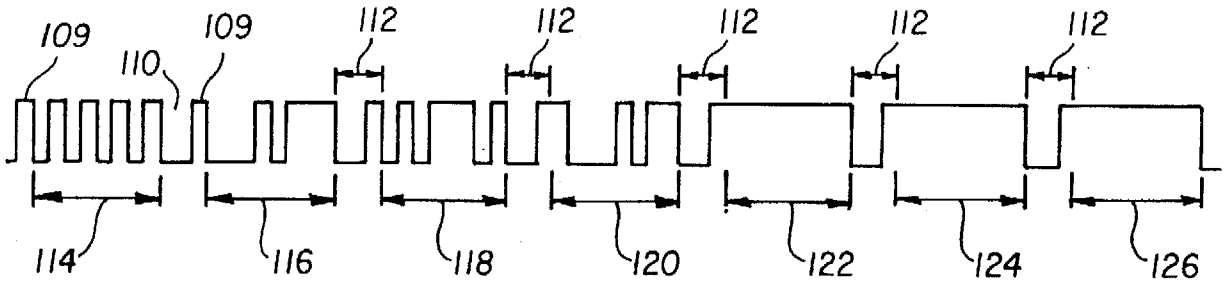
FIG. 2 is a schematic representation of a signal in the form of a serial bit stream optically transmitted by the preferred detector of FIG. 1.

FIG. 2 represents the digital signal that is encoded by micro controller 42 and transmitted optically through VLED 30. The preferred signal is a serial transmission of eight bytes each containing eight bits preceded by a start bit 109, which is a zero, and concluded with two stop bits 110, which are ones. Reference character 112 represents the stop bit followed by the start bits. The respective bytes contain detector specific information as follows:

| BYTE | DESCRIPTION |
|---|---|
| First byte, 114. | Device type and timing reference. |
| Second byte, 116. | Sample pulse. Digital representation of sample signal strength from amplifier. |
| Third byte, 118. | Alarm threshold set point. |
| Fourth byte, 120. | Clean threshold (delta) when manufactured. |
| Fifth byte, 122. | Error flags. |
| Sixth byte, 124. | Manufacture data. |
| Seventh byte, 126. | Firmware version. |
| Eighth byte (not shown). | Reserved. |

The error flags contained in the fifth byte, 122, report sensitivities that are outside the acceptable range, magnetic and factory test modes and certain detector malfunctions such as thermistor errors and last sample errors.

The transmitted information is in a hexadecimal code in reverse complement. The most significant bit to the least significant bit is from right to left. A zero or low is interpreted as a one and a one or high is interpreted as a zero. Each transmitted bit is approximately seventy two microseconds (72 μs). The total time for the depicted data stream (seven bytes or fifty six data bits and twenty start/stop bits), is five and a half milliseconds (5.5 ms). Such a transmission rate of thousands of bits per second looks to a human viewer like a single on pulse of the VLED, because the embedded data is transmitted at a rate too fast for human perception. The data is easily detected and decoded, however, by an appropriate reader 150 (FIGS. 6–9).

In this preferred embodiment, the transmitted signal is a serial bit stream optically emitted in visible wavelengths at a rate within the range of ten thousand to fifteen thousand bits per second and coded to represent alpha-numeric characters. Of course other wavelengths, data rates and code formats could be used. Also, according to the preferred embodiment, the lower perceptible blinking rate of VLED 30 and its higher imperceptible transmission rate are displaced in time. Other embodiments might imbed the faster rates in the slower rates, sending both during the same time period.

Reader 150 is in the shape of a gun including barrel 152, handle 154 and trigger 156. Optical signals transmitted from the VLED 30 (FIG. 1) are focused by appropriate optics 158 (FIG. 7) onto a sensor 160 (FIG. 8) including a photodetector 162. The trigger 156 activates the reader, and a display, preferably a liquid crystal display (LCD) 164, presents the decoded signals as symbols or alpha-numeric characters representing the transmitted information. Between the sensor 160 and LCD 164 the reader includes a micro controller 166 for controlling various operations of the reader, decoding the signal from the sensor 160 and displaying the decoded signal on the LCD 164.

Figure 9:
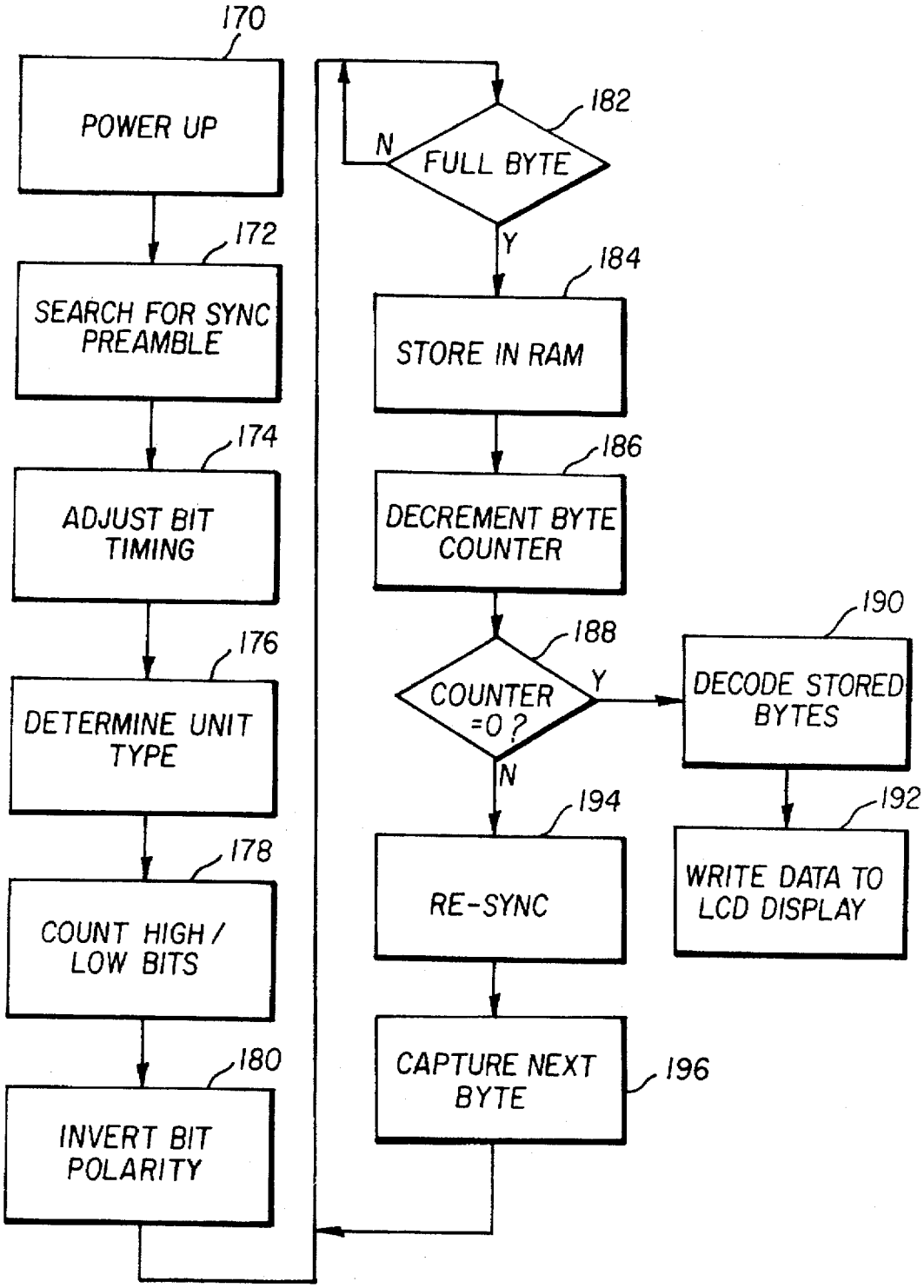
FIG. 9 is a flow diagram depicting the operation of the reader of FIGS. 6–8.

The operation of the reader 150 is depicted in a flow diagram on FIG. 9. After power up, box 170, the reader looks for the signal preamble, box 172. Information in the preamble is used to adjust timing, box 174, and identify the transmitting device, box 176. High and low bits are then counted, box 178, and the bit polarity is inverted, box 180. When a full byte is retrieved, box 182, it is stored in memory, box 184, until all eight bytes are received, boxes 186 and 188. The eight bytes are then decoded, box 190, and displayed, box 192. If synchronization is lost, the reader re-synchronizes, box 194, and continues, box 196.

It should now be apparent that the detector has two modes for initiating testing, or some other alternative function, and three modes for retrieving the resulting information. Initiation is: 1) automatic, at scheduled intervals such as the sampling cycle of the detector; and, 2) through magnetic actuation of reed switch 88 (FIG. 1). The test information can be retrieved: 1) with an analog instrument plugged into contacts 74 (FIG. 1); 2) by blinking VLED 30 at relatively slow rates directly readable by humans; and, 3) by using VLED 30 to optically transmit a coded bit stream at faster rates readable by electo-optical devices.

The invention provides for retrieving more complex data than previously available from an individual detector. Although a magnetic actuator can be used to initiate testing, and a plug-in meter can be used to retrieve the data, neither is required. The data is transmitted automatically with each sampling cycle and is retrievable remotely with an optical reader that decodes and displays the transmitted data. The same components previously used for other purposes, such as VLED 30 and micro controller 42, now have additional functions that facilitate data recovery without significantly adding to the complexity or cost of the detector.

While the invention is described in connection with a preferred embodiment, other modifications and applications will occur to those skilled in the art. The claims should be interpreted to fairly cover all such modifications and applications within the true spirit and scope of the invention.

PARTS LIST

| Reference No. | Part |
|---|---|
| 10. | Security detector |
| 12. | Sensor |
| 14. | Emitter |
| 16. | Controller |
| 18. | Housing |
| 20. | Dark chamber |
| 22. | Infrared LED |
| 24. | Photodetector |
| 26. | Septum |
| 28. | Septum |
| 30. | Visible LED |
| 32. | Driver |
| 34. | Amplifier |
| 36. | Hold & sample circuit |
| 38. | Analog to digital converter |
| 40. | Micro controller |
| 42. | Processor |
| 44. | Memory |
| 46. | Alarm latch |
| 48. | Conductor |
| 50. | VLED driver |
| 52–72 | (even numbers)-Flow chart |
| 74. | Output contacts |
| 76. | Digital to analog converter |
| 77. | Driver |
| 78 & 80 | - Flow diagram |
| 88. | Magnetic reed switch |
| 90–108 | (even numbers)-Flow chart |
| 109. | Start bit |
| 110. | Stop bits |
| 112. | Stop bits & start bit |
| 114. | First byte |
| 116. | Second byte |
| 118. | Third byte |
| 120. | Fourth byte |
| 122. | Fifth byte |
| 124. | Sixth byte |
| 126. | Seventh byte |
| 150. | Reader |
| 152. | Barrel |
| 154. | Handle |
| 156. | Trigger |
| 158. | Optics |
| 160. | Sensor |
| 162. | Photodetector |
| 164. | Liquid crystal display |
| 166. | Micro controller |
| 170–196 | (even numbers)-flow chart |

We claim:

1. A fire detector self-contained by a housing, said self-contained fire detector comprising:

an optical emitter disposed for viewing from outside said housing; and, a micro-controller within said housing, said micro-controller determining detector specific values of predetermined parameters and causing said emitter optically to transmit a multi-byte data stream including a code representing said detector specific values.

2. The invention of claim 1, wherein said controller periodically and automatically initiates cycles of said detector to determine said detector specific values.

3. The invention of claim 2, wherein said values include a representation of atmospheric density and an alarm threshold.

4. The invention of claim 1, wherein said detector has a sensitivity that changes with time, said housing contains memory addressable by said micro-controller storing factory determined calibration factors, said transmitted values include detector specific information pertaining to said sensitivity, and said values are determined by said controller periodically and automatically comparing current detector status to said calibration factors.

5. The invention of claim 1, wherein said detector measures products of combustion and wherein said values include a representation of said measurement, an alarm threshold and information from which detector sensitivity can be determined.

6. The invention of claim 1, wherein said optical emitter emits radiation in the visible spectrum and said controller operates said emitter to transmit said code at rates readable by machines and not readable by humans.

7. The invention of claim 1, wherein said code is a digital bit stream of visible radiation transmitted as thousands of bits per second.

8. The invention of claim 1, wherein said emitter is operated by said controller to transmit radiation: a) as a blinking pattern at a first rate readable by humans and b) as a serial bit stream at a second rate not readable by humans.

9. A smoke detector comprising:

a casing defining a sampling chamber;

a sensing mechanism disposed for detecting products of combustion in said chamber;

a visible-light emitting diode disposed for viewing from outside said casing;

a controller for operating said diode and optically transmitting codes including information pertaining to said detector, one of said codes as a blinking pattern in human readable cycles and another of said codes in cycles imperceptible to humans.

10. The invention of claim 9, wherein said detector has an instantaneous sensitivity that changes with time, said detector includes means providing information for estimating said instantaneous sensitivity, said human imperceptible code includes said information and said human readable code warns of instantaneous sensitivities outside a predetermined acceptable range.

11. The invention of claim 10, wherein said human imperceptible code includes measurements of said products of combustion, an alarm threshold and said sensitivity information.

12. The invention of claim 9, wherein said human imperceptible code is a digital bit stream transmitted at a rate of thousands of bits per second.

13. A security detector including a sensor of a security condition, an alarm mechanism responsive to the sensor for warning of the condition, an optical emitter for transmitting optical energy in the visible spectrum and an encoder for modulating the energy from the emitter to transmit information pertaining to the detector; characterized in that:

said encoder has a first mode transmitting said information at a human perceptible rate and a second mode transmitting said information as a multi-byte data stream at a rate not readable by humans.

14. The invention of claim 13, wherein said emitter is a visible-light emitting diode.

15. The invention of claim 13, wherein said sensor has a sensitivity that changes over time, said detector has means for estimating the instantaneous sensitivity of said sensor and comparing said estimated instantaneous sensitivity to an acceptable range, and said human perceptible data includes a first code when said instantaneous sensitivity is above said acceptable range and a second code different from said first code when said instantaneous sensitivity is below said acceptable range.

16. A security detector comprising:

an optical emitter disposed for viewing from outside said detector;

a controller operating said detector in cycles including a) a detecting mode for detecting security related events and determining information for estimating an instantaneous sensitivity of said detector to said events, and b) a communicating mode for operating said emitter optically to transmit a digital bit stream including said information as binary data in a byte-wide format.

17. A method of operating a security detector including the steps of:

operating said detector to detect a predetermined security related event;

operating said detector to collect information for determining instantaneous sensitivity of said detector to said predetermined security related event; and, operating an optical emitter disposed for viewing from outside said detector to transmit said sensitivity information as a digital bit stream at rates in the thousands of bits per second.

18. A method of operating a security detector including the steps of:

operating said detector in a monitoring mode to detect a predetermined security related event;

operating said detector in a test mode to establish information for determining instantaneous sensitivity of said detector to said predetermined security related event;

operating an optical emitter disposed for viewing from outside said detector to transmit codes pertaining to said sensitivity information, one code as a blinking pattern perceptible to humans and another code as a serial bit stream at rates readable by machines and not readable by humans.

19. A security system comprising:

a smoke detector having an emitter of radiation in the visible spectrum and an encoder for modulating said radiation to transmit information pertaining to said detector, said encoder having a first state for modulating said radiation to transmit said information at a first rate readable by humans and a second state for modulating said radiation to transmit said information as alpha-numeric data at a second rate readable by machine and not readable by humans; and, a reader optically reading said transmitted data at said second rate, said reader including a display presenting said decoded data in human readable alpha-numeric characters.

* * * * *